US011821422B2

(12) United States Patent
Hattori et al.

(10) Patent No.: US 11,821,422 B2
(45) Date of Patent: Nov. 21, 2023

(54) SCROLL COMPRESSOR WITH A THIN SECTION IN THE ORBITING VOLUTE WALL

(71) Applicant: KABUSHIKI KAISHA TOYOTA JIDOSHOKKI, Aichi-ken (JP)

(72) Inventors: Yuya Hattori, Kariya (JP); Shiori Yamamoto, Kariya (JP); Takumi Maeda, Kariya (JP)

(73) Assignee: KABUSHIKI KAISHA TOYOTA JIDOSHOKKI, Aichi-Ken (JP)

( * ) Notice: Subject to any disclaimer, the term of this patent is extended or adjusted under 35 U.S.C. 154(b) by 0 days.

(21) Appl. No.: 17/956,116

(22) Filed: Sep. 29, 2022

(65) Prior Publication Data

US 2023/0107523 A1 Apr. 6, 2023

(30) Foreign Application Priority Data

Oct. 6, 2021 (JP) ..... 2021-164862

(51) Int. Cl.
*F04C 18/02* (2006.01)

(52) U.S. Cl.
CPC ..... *F04C 18/0215* (2013.01); *F04C 18/0246* (2013.01); *F04C 18/0269* (2013.01)

(58) Field of Classification Search
CPC ..... F04C 18/0215; F04C 18/0246; F04C 18/0269
See application file for complete search history.

(56) References Cited

U.S. PATENT DOCUMENTS

| | | | | |
|---|---|---|---|---|
| 6,527,526 | B2 * | 3/2003 | Chang | F04C 18/0269 418/55.2 |
| 9,765,781 | B2 * | 9/2017 | Murakami | F04C 18/0269 |
| 11,118,583 | B2 * | 9/2021 | Watanabe | F04C 18/0215 |

FOREIGN PATENT DOCUMENTS

| | | | |
|---|---|---|---|
| FR | 3053090 | A1 | 12/2017 |
| IN | 202014036583 | A | 3/2021 |
| JP | H06-336985 | A | 12/1994 |
| JP | 2020-193582 | A | 12/2020 |
| WO | WO2013/104980 | A1 | 7/2013 |

* cited by examiner

*Primary Examiner* — Mary Davis
(74) *Attorney, Agent, or Firm* — Greenblum & Bernstein, P.L.C.

(57) ABSTRACT

A scroll compressor includes a fixed scroll and an orbiting scroll. The orbiting scroll includes an orbiting volute wall. The orbiting volute wall is shaped to form an involute and to have a thickness. The orbiting volute wall includes a thin section in which the thickness is less than those in adjacent sections. The thin section includes a region corresponding to an involute angle that is obtained by subtracting 360° from a maximum of the involute angle.

4 Claims, 3 Drawing Sheets

SCROLL COMPRESSOR WITH A THIN SECTION IN THE ORBITING VOLUTE WALL

BACKGROUND

1. Field

The present disclosure relates to a scroll compressor.

2. Description of Related Art

A scroll compressor includes a fixed scroll, which is fixed in a housing, and an orbiting scroll, which orbits relative to the fixed scroll (for example, refer to Japanese Laid-Open Patent Publication No. 2020-193582).

The fixed scroll includes a fixed base plate and a fixed volute wall, which extends from the fixed base plate. The orbiting scroll includes an orbiting base plate and an orbiting volute wall, which extends from the orbiting base plate. The fixed volute wall and the orbiting volute wall mesh each other to define compression chambers. Orbiting motion of the orbiting scroll reduces the volume of each compression chamber so as to compress fluid.

The size of a scroll compressor needs to be suitable for the installation site. This puts a limit on the size of the scroll compressor. On the other hand, the performance of scroll compressors is desired to be improved by increasing the amount of fluid that can be trapped in the compression chambers. In other words, the compression efficiency of scroll compressors is desired to be increased within size limitations.

SUMMARY

This Summary is provided to introduce a selection of concepts in a simplified form that are further described below in the Detailed Description. This Summary is not intended to identify key features or essential features of the claimed subject matter, nor is it intended to be used as an aid in determining the scope of the claimed subject matter.

In one aspect, a scroll compressor includes a fixed scroll and an orbiting scroll. The fixed scroll includes a fixed base plate and a fixed volute wall extending from the fixed base plate. The orbiting scroll includes a disc-shaped orbiting base plate and an orbiting volute wall. The orbiting base plate faces the fixed base plate. The orbiting volute wall extends from the orbiting base plate toward the fixed base plate and meshes with the fixed volute wall. The scroll compressor is configured such that the orbiting scroll orbits so as to compress a fluid in a compression chamber that is defined by the fixed scroll and the orbiting scroll. The orbiting volute wall is shaped to form an involute and to have a thickness. The orbiting volute wall includes a thin section in which the thickness is less than thicknesses of the adjacent sections. The thin section includes a region corresponding to an involute angle that is obtained by subtracting 360° from a maximum of the involute angle.

Other features and aspects will be apparent from the following detailed description, the drawings, and the claims.

BRIEF DESCRIPTION OF THE DRAWINGS

Throughout the drawings and the detailed description, the same reference numerals refer to the same elements. The drawings may not be to scale, and the relative size, proportions, and depiction of elements in the drawings may be exaggerated for clarity, illustration, and convenience.

DETAILED DESCRIPTION

This description provides a comprehensive understanding of the methods, apparatuses, and/or systems described. Modifications and equivalents of the methods, apparatuses, and/or systems described are apparent to one of ordinary skill in the art. Sequences of operations are exemplary, and may be changed as apparent to one of ordinary skill in the art, with the exception of operations necessarily occurring in a certain order. Descriptions of functions and constructions that are well known to one of ordinary skill in the art may be omitted.

Exemplary embodiments may have different forms, and are not limited to the examples described. However, the examples described are thorough and complete, and convey the full scope of the disclosure to one of ordinary skill in the art.

In this specification, "at least one of A and B" should be understood to mean "only A, only B, or both A and B."

A scroll compressor 10 according to one embodiment will now be described with reference to FIGS. 1 to 5. One example of the installation site of the scroll compressor 10 is a vehicle.

<Housing>

Figure 1:
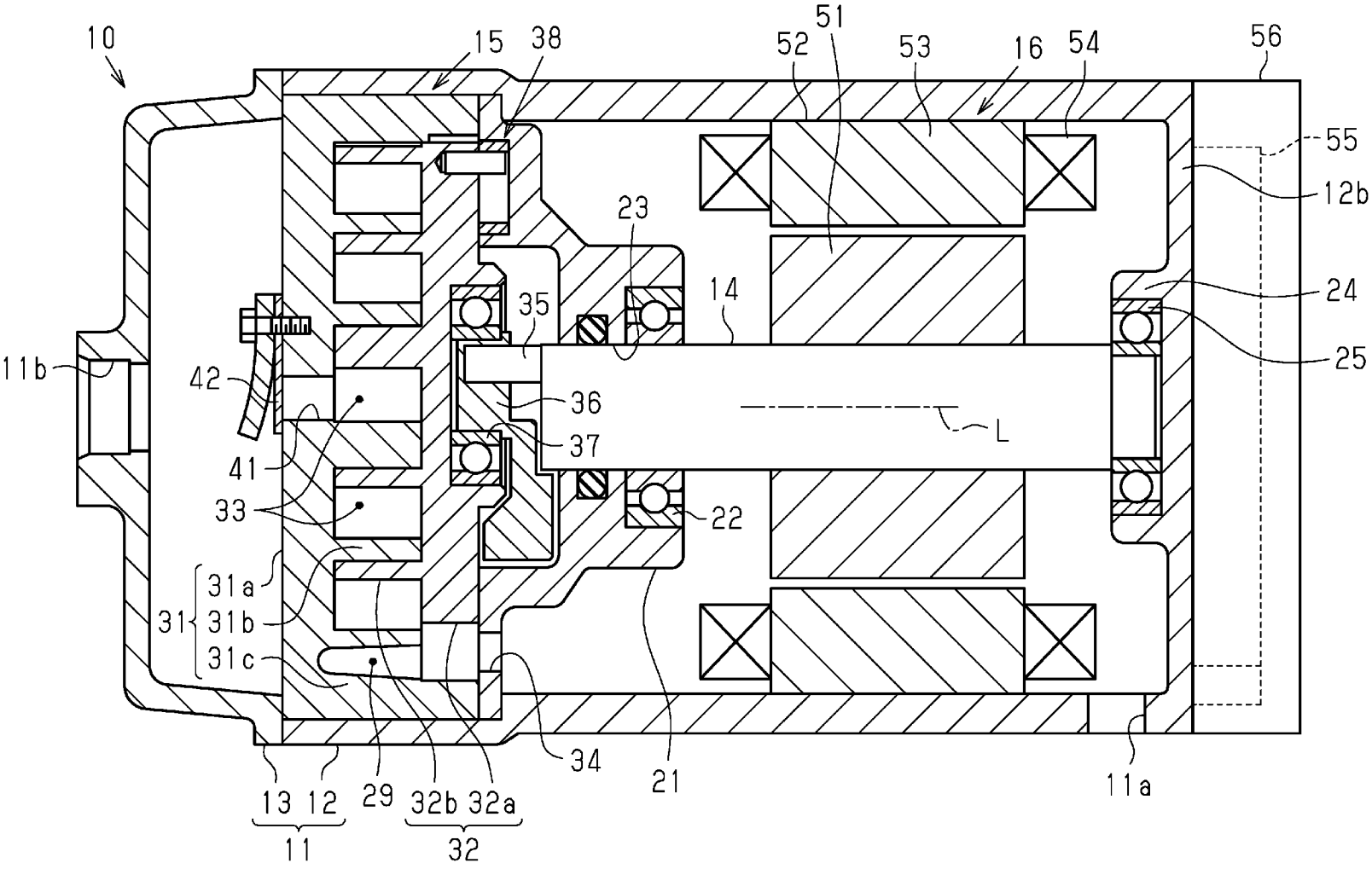
FIG. 1 is a cross-sectional view showing a scroll compressor according to one embodiment.

As shown in FIG. 1, the scroll compressor 10 is an electric scroll compressor. The scroll compressor 10 includes a housing 11. The housing 11 includes an inlet 11*a*, through which fluid is drawn in, and an outlet 11*b*, from which fluid is discharged. The housing 11 has a substantially cylindrical shape as a whole.

The housing 11 includes a cylindrical first component 12, which has a closed end, and a second component 13. The first component 12 and the second component 13 are coupled to each other with their open ends abutting against each other. The inlet 11*a* is provided in the first component 12. The outlet 11*b* is provided in the second component 13.

The scroll compressor 10 includes a rotary shaft 14, a compression unit 15, and an electric motor 16. The rotary shaft 14, the compression unit 15, and the electric motor 16 are accommodated in the housing 11.

<Rotary Shaft>

The rotary shaft 14 is rotatably accommodated in the housing 11. The housing 11 accommodates a shaft supporting member 21, which supports the rotary shaft 14. The shaft supporting member 21 is fixed to the housing 11, for example, at a position between the compression unit 15 and the electric motor 16. The shaft supporting member 21 has an insertion hole 23. A first bearing 22 is provided in the insertion hole 23. The rotary shaft 14 extends through the insertion hole 23. The shaft supporting member 21 faces a bottom 12*b* of the first component 12. A cylindrical boss 24 protrudes from the bottom 12*b*. A second bearing 25 is provided inside the boss 24. The rotary shaft 14 is rotatably supported by the housing 11 with the bearings 22, 25.

<Electric Motor>

The electric motor 16 is arranged in a part of the housing 11 that is close to the inlet 11*a*. The electric motor 16 rotates the rotary shaft 14. The electric motor 16 drives the compression unit 15. The electric motor 16 includes a rotor 51, which rotates integrally with the rotary shaft 14, and a stator 52, which surrounds the rotor 51. The rotor 51 is coupled to the rotary shaft 14. The stator 52 is fixed to the inner peripheral surface of the first component 12 of the housing 11. The stator 52 includes a stator core 53, which faces the cylindrical rotor 51 in the radial direction, and a coil 54, which is wound about the stator core 53.

<Compression Unit>

The compression unit 15 is arranged in a part of the housing 11 that is closer to the outlet 11*b* than the electric motor 16. The compression unit 15 compresses fluid drawn in through the inlet 11*a* and discharges it from the outlet 11*b*. The compression unit 15 includes a fixed scroll 31 and an orbiting scroll 32. The fixed scroll 31 is fixed to the housing 11. The orbiting scroll 32 is permitted to orbit with respect to the fixed scroll 31.

The fixed scroll 31 includes a fixed base plate 31*a*, a fixed volute wall 31*b*, and a partition wall 31*c*. The fixed base plate 31*a* has the shape of a disc that is coaxial with the rotary shaft 14. The fixed volute wall 31*b* extends from the fixed base plate 31*a*. The partition wall 31*c* extends from the outer peripheral edge of the fixed base plate 31*a*. The partition wall 31*c* is located on the outer side of the fixed volute wall 31*b* in the radial direction of the fixed base plate 31*a*.

The orbiting scroll 32 includes an orbiting base plate 32*a* and an orbiting volute wall 32*b*. The orbiting base plate 32*a* has the shape of a disc that faces the fixed base plate 31*a*. The orbiting volute wall 32*b* extends toward the fixed base plate 31*a* from the orbiting base plate 32*a*.

The orbiting scroll 32 is accommodated in a space 29 defined in the housing 11. The space 29 is defined by the shaft supporting member 21, the fixed base plate 31*a*, and the partition wall 31*c*. The orbiting scroll 32 orbits in the space 29.

The fixed scroll 31 and the orbiting scroll 32 mesh with each other. Specifically, the fixed volute wall 31*b* and the orbiting volute wall 32*b* mesh with each other. The distal end face of the fixed volute wall 31*b* is in contact with the orbiting base plate 32*a*, and the distal end face of the orbiting volute wall 32*b* is in contact with the fixed base plate 31*a*. The fixed scroll 31 and the orbiting scroll 32 define compression chambers 33 that compress fluid. The scroll compressor 10 includes multiple compression chambers 33.

The compression chambers 33 include two compression chambers: a first compression chamber, which is defined by the inner periphery of the fixed volute wall 31*b* and the outer periphery of the orbiting volute wall 32*b*, and a second compression chamber, which is defined by the outer periphery of the fixed volute wall 31*b* and the inner periphery of the orbiting volute wall 32*b*.

When making an orbiting motion, the orbiting scroll 32 moves along a circular path. The radius of the circular path is referred to as an orbital radius. The orbiting volute wall 32*b* is provided not to protrude outward from the outer peripheral edge of the orbiting base plate 32*a*. Thus, the orbital radius of the orbiting scroll 32 is determined by the diameter of the orbiting base plate 32*a*. Since the orbiting scroll 32 orbits within the space 29, the diameter of the orbiting base plate 32*a* is determined by the size of the space 29.

The shaft supporting member 21 has a suction passage 34. The suction passage 34 is used to draw fluid into the compression chambers 33. The orbiting scroll 32 is configured to orbit as the rotary shaft 14 rotates. Specifically, a part of the rotary shaft 14 protrudes toward the compression unit 15 through the insertion hole 23 of the shaft supporting member 21. The rotary shaft 14 includes an eccentric shaft 35 on an end face closer to the compression unit 15. The eccentric shaft 35 is located in a position eccentric to an axis L of the rotary shaft 14. A bushing 36 is attached to the eccentric shaft 35. The bushing 36 is coupled to the orbiting base plate 32*a* with a bearing 37.

The scroll compressor 10 includes rotation prohibiting units 38. Each of the rotation prohibiting units 38 prohibits the orbiting scroll 32 from rotating, while permitting the orbiting scroll 32 to orbit. When the rotary shaft 14 rotates in a predetermined forward direction, the orbiting scroll 32 orbits in the forward direction. The orbiting scroll 32 orbits in the forward direction about the axis of the fixed scroll 31, that is, about the axis L of the rotary shaft 14. This reduces the volume of the first compression chamber and the second compression chamber and thus compresses the fluid that has been drawn into the first compression chamber and the second compression chamber through the suction passage 34. The compressed fluid is discharged from a discharge port 41 in the fixed base plate 31*a*. The fluid discharged from the discharge port 41 is discharged from the outlet 11*b*. The fixed base plate 31*a* is provided with a discharge valve 42, which covers the discharge port 41. The fluid compressed in the compression chambers 33 flexes the discharge valve 42 to be discharged from the discharge port 41.

<Inverter>

The scroll compressor 10 includes an inverter 55. The inverter 55 is a drive circuit that drives the electric motor 16. The inverter 55 is accommodated in a cylindrical cover member 56, which is attached to the bottom 12*b* of the first component 12 of the housing 11. The inverter 55 is electrically connected to the coil 54.

<Detailed Description of Orbiting Scroll>

Figure 2:
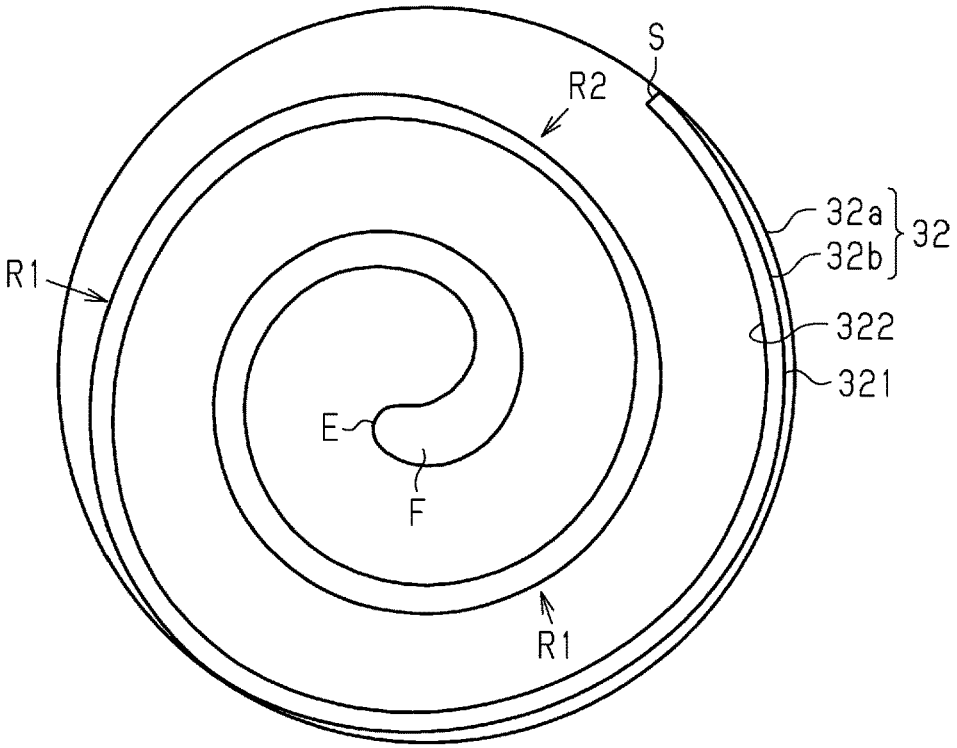
FIG. 2 is a diagram showing an orbiting scroll.

FIG. 2 only illustrates the orbiting base plate 32*a* and the orbiting volute wall 32*b* of the orbiting scroll 32. The orbiting volute wall 32*b* has a volute shape that extends from a first end E, which is located at the center of the volute, to a second end S, which is located at the outer periphery of the volute.

An end portion of the orbiting volute wall 32*b* that includes the first end E has an arcuate shape. Except for some parts, the orbiting volute wall 32*b* has a shape that extends along an involute and has a thickness. Except for some parts, an outer surface 321 and an inner surface 322 of the orbiting volute wall 32*b* each have the shape of an involute.

An involute is a plane curve in which a normal to the involute is always a tangent to a base circle. In other words, an involute is a plane curve that is formed by the locus drawn by a point on a straight line when that straight line is rolled on a fixed base circle without sliding.

An involute, which is also known as an evolvent, is a locus drawn by the endpoint of a thread when that thread, which is wound around a base circle, is unwound while being kept taut. An involute angle is defined as a rotational angle of the thread when that thread is unwound about the center of the base circle while being kept taut. In the orbiting volute wall 32*b*, the first end E corresponds to the winding start of the involute, and the second end S corresponds to the winding end of the involute.

The orbiting volute wall 32*b* includes an arcuate portion F, which is continuous with the winding start of the involute. The arcuate portion F is an arc that is continuous with the first end E of the orbiting volute wall 32*b*.

Each point on the path along the orbiting volute wall 32*b* from the first end E, which is the winding start of the involute represented by the orbiting volute wall 32*b*, to the second end S, which is winding end of the involute, is expressed by an involute angle [° ]. The minimum of the involute angle is 0 at the first end E. The involute angle increases from the first end E toward the second end S along the orbiting volute wall 32*b*. The winding number of the fixed volute wall 31*b* and the orbiting volute wall 32*b* is, for example, approximately two and half. In this case, the maximum of the involute angle is approximately 900°.

<Thickness of Orbiting Volute Wall>

The dimension of the orbiting volute wall 32*b* between the outer surface 321 and the inner surface 322 is defined as a thickness W [mm]. As described above, except for some parts, the outer surface 321 and the inner surface 322 of the orbiting volute wall 32*b* each have the shape of an involute. More specifically, the inner surface 322 is formed by an involute that is offset from the involute forming the outer surface 321 by such an amount that the inner surface 322 will not contact the fixed volute wall 31*b* during orbiting motion.

Figure 5:
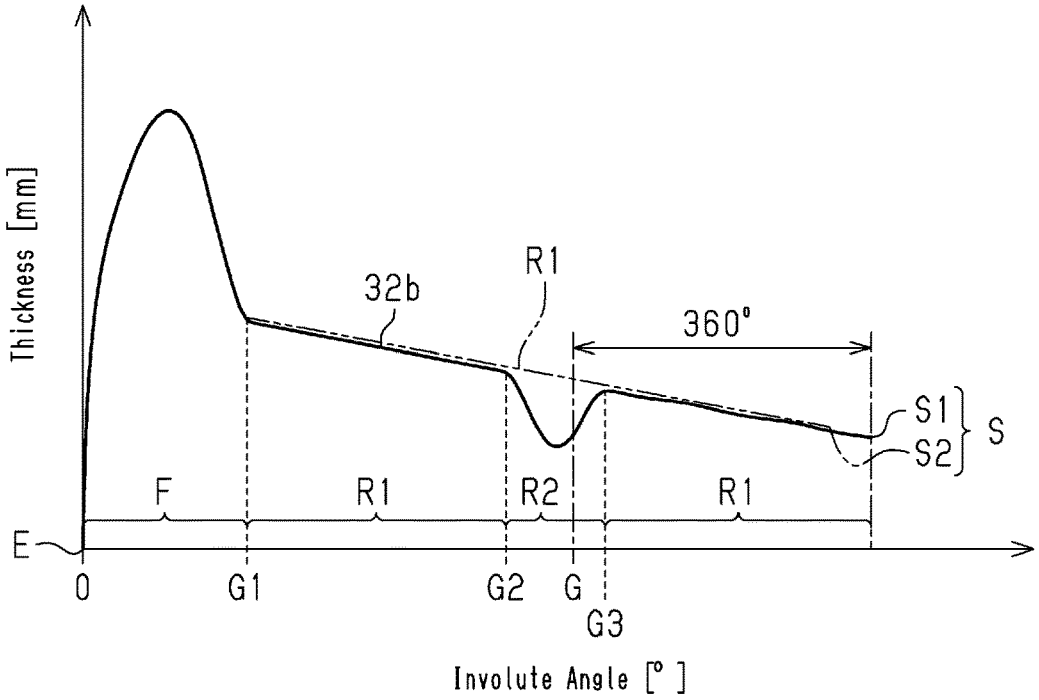
FIG. 5 is a graph showing the relationship between a thickness and an involute angle.

As shown in FIGS. 2 and 5, as the involute angle increases from the minimum along the arcuate portion F, the thickness W of the orbiting volute wall 32*b* rapidly increases to reach the local maximum and then decreases rapidly.

The orbiting volute wall 32*b* includes linear sections R1 and a non-linear section R2, which are defined by the relationship between the involute angle and the thickness W. The orbiting volute wall 32*b* includes the linear sections R1 and the non-linear section R2 between the minimum and the maximum of the involute angle. Specifically, the orbiting volute wall 32*b* includes two linear sections R1 and one non-linear section R2 in a region where the involute angle is greater than that in the arcuate portion F. That is, the arcuate portion F, a linear section R1, the non-linear section R2, and the additional linear section R1 are arranged in that order between the first end E and the second end S of the orbiting volute wall 32*b*.

The linear sections R1 are parts of the region from the minimum to the maximum of the involute angle. Each linear section R1 is a region in which the thickness W linearly decreases in accordance with increase in the involute angle. The rate of a decrease in the thickness W to an increase in the involute angle is defined as a rate of change of thickness. Each of the two linear sections R1 is a region in which the rate of change of thickness is constant. In each of the two linear sections R1, the thickness W of the orbiting volute wall 32*b* linearly decreases as the involute angle increases. The involute angle at the boundary between one of the linear sections R1 that corresponds to the smaller involute angles and the arcuate portion F will be referred to as a first involute angle G1. The two linear sections R1 are provided on opposite sides of the non-linear section R2, which will be discussed below.

The non-linear section R2 is a part of the region from the minimum to the maximum of the involute angle. The non-linear section R2 is a region in which the thickness W changes non-linearly in accordance with an increase in the involute angle. The non-linear section R2 includes a local minimum of the thickness W. Aside from the arcuate portion F, the non-linear section R2 is a region in which the thickness W changes rapidly within the range from the first end E to the second end S of the orbiting volute wall 32*b*. Of the boundaries between the two linear sections R1 and the non-linear section R2, the boundary between the linear section R1 that corresponds to the smaller involute angles and the non-linear section R2 will be referred to as a second involute angle G2. Also, the boundary between the linear section R1 that corresponds to the larger involute angles and the non-linear section R2 will be referred to as a third involute angle G3. Accordingly, the non-linear section R2 is a region that is located between the second involute angle G2 and the third involute angle G3. The non-linear section R2, which is defined by the second involute angle G2 and the third involute angle G3, is a thin section in which the thickness W is less than those in the adjacent sections. Therefore, the orbiting volute wall 32*b* includes a thin section in which the thickness W is less than those in the adjacent sections.

In the non-linear section R2, the thickness W rapidly decreases as the involute angle increases from the second involute angle G2 to reach a local minimum, and then increases rapidly from the local minimum toward the third involute angle G3. The thickness W of the orbiting volute wall 32*b* thus has the local minimum in the non-linear section R2.

As shown in FIG. 2, the outer surface 321 and the inner surface 322 of the orbiting volute wall 32*b* are displaced to approach each other in the non-linear section R2. That is, the thickness W is not reduced by displacing only one of the outer surface 321 and the inner surface 322. The thickness W of the orbiting volute wall 32*b* is the smallest in a position where the outer surface 321 and the inner surface 322 are close to each other in the thickness direction of the orbiting volute wall 32*b*. The orbiting volute wall 32*b* has a local minimum in a position where the thickness W is the smallest.

As shown in FIG. 5, an involute angle obtained by subtracting 360° from the second end S in the orbiting volute wall 32*b* is defined as a reference involute angle G. The reference involute angle G is located within the non-linear section R2. That is, the reference involute angle G is located between the second involute angle G2 and the third involute angle G3. Thus, the non-linear section R2 includes an involute angle obtained by subtracting 360° from the maximum of the involute angle. Therefore, the reference involute angle G is located in a position where the thickness W of the orbiting volute wall 32*b* is smaller than those in the linear sections R1.

Also, the local minimum of the thickness W of the orbiting volute wall 32*b* is located closer to the first end E than the reference involute angle G. That is, the local minimum of the thickness W is located at an involute angle that is smaller than the reference involute angle G. Thus, with regard to the orbiting volute wall 32*b*, the thickness W has the local minimum in a region in the non-linear section R2 that corresponds to an involute angle obtained by subtracting an angle greater than or equal to 360° from the maximum of the involute angle. Therefore, the section of the orbiting volute wall 32*b* in which the thickness W is the smallest is located in a position in the non-linear section R2 that corresponds to an involute angle that is smaller than the involute angle obtained by subtracting an angle greater than or equal to 360° from the maximum of the involute angle. The second end S of the orbiting volute wall 32*b* overlaps with the non-linear section R2 in a radial direction of the orbiting base plate 32*a*.

<Operation and Advantages>

An operation and advantages of the scroll compressor 10 will now be described.

Figure 3:
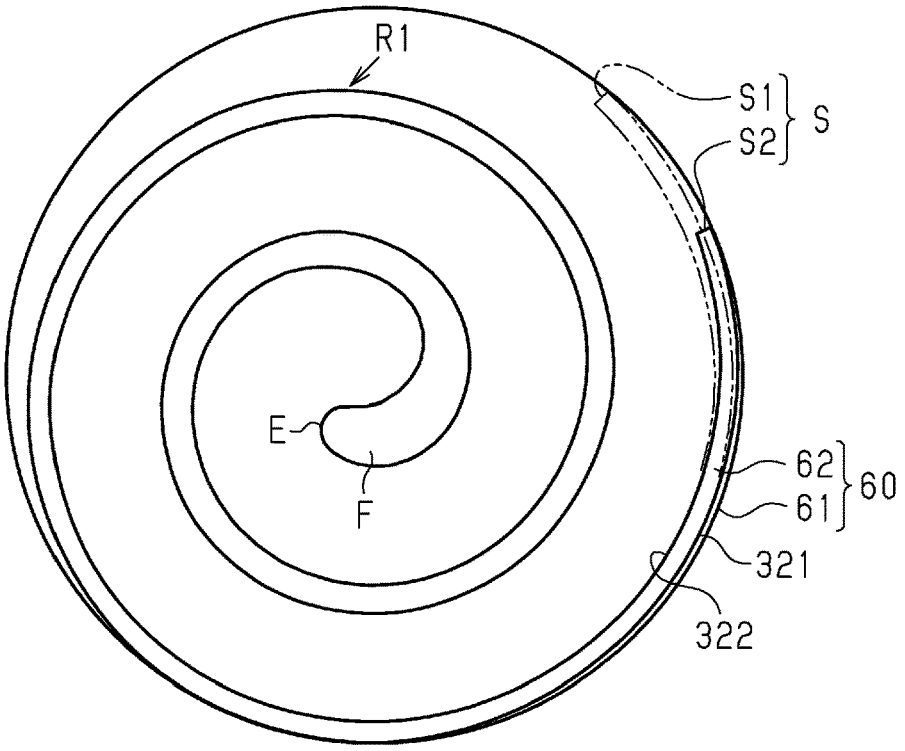
Fig.3 (Prior Art)
FIG. 3 is a diagram showing an orbiting scroll of a comparative example.
Figure 4:
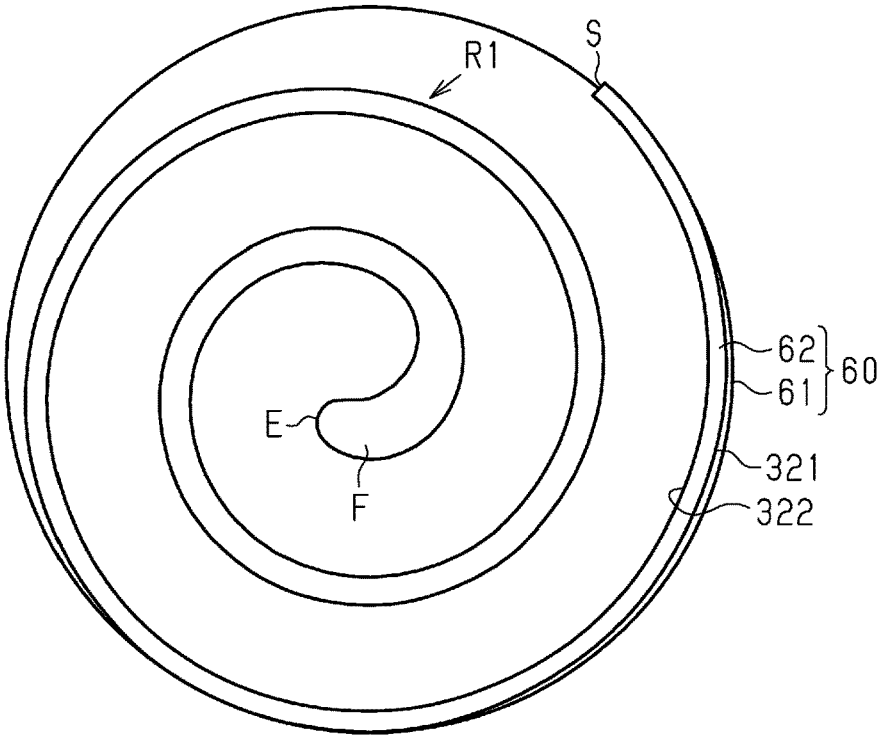
Fig.4 (Prior Art)
FIG. 4 is a diagram showing an orbiting scroll of a comparative example.

(1) FIGS. 3 and 4 show orbiting scrolls 60 of comparative examples. The orbiting scrolls 60 of the comparative examples are orbiting scrolls used in typical scroll compressors.

The orbiting scrolls 60 of the comparative examples each include an orbiting base plate 61 and an orbiting volute wall 62, which does not have the non-linear section R2. As indicated by the long-dash double-short-dash line in FIG. 5, the thickness W of the orbiting volute wall 62 of the comparative example linearly decreases from the first involute angle G1 to the second end S as the involute angle increases. That is, the thickness W of the orbiting volute wall 62 of the comparative example decreases at a constant rate of change from the first involute angle G1. Therefore, except for the arcuate portion F, the orbiting volute wall 62 of the comparative example is a linear section RE In order to clearly distinguish the present embodiment and the comparative example, the second end S of the present embodiment is denoted by S1, and the second end S of the comparative example is denoted by S2 in FIGS. 3 and 5. As shown in FIG. 3, the involute angle at the second end S2 of the comparative example is smaller than the involute angle at the second end S1 of the present embodiment. Thus, the winding number of the orbiting volute wall 32*b* of the present embodiment is greater than the winding number of the orbiting volute wall 62 of the comparative example.

In the orbiting scroll 60 of the comparative example shown in FIG. 4, the diameter of the orbiting base plate 61 is equal to the diameter of the orbiting base plate 32*a*. In this comparative example, an increase in the winding number of the orbiting volute wall 62 causes the position of the second end S, in which the involute angle is maximum, to protrude outward from the outer edge of the orbiting base plate 61. In contrast, in the present embodiment, the thickness W of a region of the orbiting volute wall 32*b* located in a position corresponding to the involute angle obtained by subtracting 360° from the position where the second end S, which would protrude outward, is less than those in the adjacent regions. Accordingly, the position of the second end S of the orbiting volute wall 32*b* is inward of the outer edge of the orbiting base plate 32*a* as shown in FIG. 2. As a result, the winding number of the orbiting volute wall 32*b* can be increased as compared to that in the comparative example, without causing the second end S to protrude outward from the outer edge of the orbiting base plate 32*a*. That is, as indicated by the long-dash double-short-dash line in FIG. 3, the position of the second end S in which the involute angle has the maximum can be shifted to the second end S1 of the present embodiment from the second end S2 of the comparative example in the circumferential direction of the orbiting base plate 32*a*. In other words, the winding number of the orbiting volute wall 32*b* is increased without increasing the size of the orbiting base plate 32*a*.

Accordingly, as compared to the comparative example, the amount of fluid trapped in the first compression chamber in the orbiting scroll 32 of the present embodiment is increased due to the non-linear section R2. That is, since the thickness W is reduced by recessing the outer surface 321 of the orbiting volute wall 32*b*, the amount of fluid trapped in the first compression chamber increases.

Likewise, as compared to the comparative example, the amount of fluid trapped in the second compression chamber is increased due to the non-linear section R2. That is, since the thickness W is reduced by recessing the inner surface 322 of the orbiting volute wall 32*b*, the amount of fluid trapped in the second compression chamber increases.

Therefore, the orbiting scroll 32, which has the non-linear section R2, increases the winding number of the orbiting volute wall 32*b* without increasing the size of the orbiting base plate 32*a*. An increase in winding number of the orbiting volute wall 32*b* increases the amount of fluid trapped in the compression chambers 33. This increases the compression efficiency of the scroll compressor 10.

Even though a limit is put on the size of the scroll compressor 10 when the ease of installation in the installation site is taken into consideration, the compression efficiency can be increased without increasing the size of the orbiting scroll 32 and thus without increasing the size of the housing 11.

(2) The thin section is the non-linear section R2. The thickness W of the orbiting volute wall 32*b* has the local minimum in the non-linear section R2. The scroll compressor 10 includes the linear sections R1, which are adjacent to the non-linear section R2, which includes a thin section. Since the non-linear section R2, which includes a thin section, is provided, the winding number of the orbiting volute wall 32*b* is increased without reducing the performance as compared to a typical scroll compressor.

(3) The thickness W of the orbiting volute wall 32*b* is a local minimum at an involute angle obtained by subtracting an angle greater than or equal to 360° from the maximum of the involute angle. Thus, the non-linear section R2 is formed by an involute angle smaller than the position corresponding to the involute angle obtained by subtracting an angle greater than or equal to 360° from the second end S of the orbiting volute wall 32*b*.

(4) The non-linear section R2 is located in a position that includes an involute angle obtained by subtracting 360° from the maximum of the involute angle. Thus, the thickness W in a region that forms the outer periphery of the orbiting volute wall 32*b* is not smaller than the thickness W formed by an involute. Therefore, even though the orbiting volute wall 32*b* includes the non-linear section R2, the stiffness in the outer periphery is not reduced. This suppresses vibrations in the orbiting volute wall 32*b*.

(5) Since the orbiting volute wall 32*b* includes the non-linear section R2, the winding number of the orbiting volute wall 32*b* is greater than that in the comparative example. Accordingly, the winding number of the fixed volute wall 31*b* is longer than that in the comparative example. This extends the compression process by the fixed volute wall 31*b* and the orbiting volute wall 32*b*, that is, the time period from the start of compression to discharge. Excess compression is thus restricted. Also, the winding numbers of the orbiting volute wall 32*b* and the fixed volute wall 31*b* are increased. This reduces the pressure difference between multiple compression chambers 33 at a given point in time. This prevents recompression from occurring.

The above-described embodiment may be modified as follows. The above-described embodiment and the following modifications can be combined as long as the combined modifications remain technically consistent with each other.

The non-linear section R2 may be formed by recessing one of the outer surface 321 and the inner surface 322 toward the other.

The region in which the thickness W has a local minimum may be located at the reference involute angle G, which is obtained by subtracting 360° from the maximum of the involute angle, or may be located in a position corresponding to an involute angle greater than the reference involute angle G.

The orbiting volute wall 32*b* may include multiple regions in each of which the thickness W has a local minimum. In this case, the reference involute angle G is included in one of the non-linear sections R2, each of which includes a region in which the thickness W has a local minimum.

The maximum of the involute angle of the orbiting volute wall 32*b* may be changed to change the winding number. For example, the maximum of the involute angle of the orbiting volute wall 32*b* may be slightly greater than 360° to make the winding number slightly greater than one. Alternatively, the maximum of the involute angle may be 540° so that the winding number is one and a half. Further, the maximum of the involute angle of the orbiting volute wall 32*b* may be 1080° so that the winding number is three. The number of positions of the non-linear sections R2 may be adjusted in accordance with the winding number.

The scroll compressor 10 does not need to be an electric scroll compressor, but may be a scroll compressor 10 driven by an engine.

Various changes in form and details may be made to the examples above without departing from the spirit and scope of the claims and their equivalents. The examples are for the sake of description only, and not for purposes of limitation. Descriptions of features in each example are to be considered as being applicable to similar features or aspects in other examples. Suitable results may be achieved if sequences are performed in a different order, and/or if components in a described system, architecture, device, or circuit are combined differently, and/or replaced or supplemented by other components or their equivalents. The scope of the disclosure is not defined by the detailed description, but by the claims and their equivalents. All variations within the scope of the claims and their equivalents are included in the disclosure.

What is claimed is:

1. A scroll compressor, comprising:

a fixed scroll that includes a fixed base plate and a fixed volute wall extending from the fixed base plate; and an orbiting scroll that includes a disc-shaped orbiting base plate and an orbiting volute wall, the orbiting base plate facing the fixed base plate, and the orbiting volute wall extending from the orbiting base plate toward the fixed base plate and meshing with the fixed volute wall, wherein the scroll compressor is configured such that the orbiting scroll orbits so as to compress a fluid in a compression chamber that is defined by the fixed scroll and the orbiting scroll, the orbiting volute wall is shaped to form an involute and to have a thickness, the orbiting volute wall includes a thin section in which the thickness is less than thicknesses of the adjacent sections, and the thin section includes a region corresponding to an involute angle that is obtained by subtracting 360° from a maximum of the involute angle.

2. The scroll compressor according to claim 1, wherein the orbiting volute wall includes:

a linear section that is a region in which the thickness linearly decreases in accordance with an increase in the involute angle; and a non-linear section that is a region in which the thickness changes non-linearly in accordance with an increase in the involute angle, the thin section includes the non-linear section, and the thickness has a local minimum in the non-linear section.

3. The scroll compressor according to claim 2, wherein, with regard to the orbiting volute wall, the thickness has a local minimum in a region in the non-linear section that corresponds to an involute angle obtained by subtracting an angle greater than or equal to 360° from the maximum of the involute angle.

4. The scroll compressor according to claim 2, wherein the orbiting volute wall includes a first end, which corresponds to a winding start of the involute, and a second end, which corresponds to a winding end of the involute, the orbiting volute wall includes an arcuate portion, and the arcuate portion, the linear section, the non-linear section, and an additional linear section are arranged in that order between the first end and the second end of the orbiting volute wall.

* * * * *